United States Patent [19]

Wills et al.

[11] 4,042,022

[45] Aug. 16, 1977

[54] DEVICES FOR CENTRALIZING PIPES IN BORINGS

[75] Inventors: Stephen Francis Edmund Wills; Henry Edward Pledger, both of Bedford, England

[73] Assignee: Weatherford Oil Tool (U. K.) Limited, Norfolk, England

[21] Appl. No.: 619,859

[22] Filed: Oct. 6, 1975

[30] Foreign Application Priority Data

| | | |
|---|---|---|
| Oct. 8, 1974 | United Kingdom | 43544/74 |
| Feb. 21, 1975 | United Kingdom | 7425/75 |

[51] Int. Cl.[2] ..... E21B 17/10

[52] U.S. Cl. ..... 166/241

[58] Field of Search ..... 166/241, 170–175, 166/138, 166; 308/4 A

[56] References Cited

U.S. PATENT DOCUMENTS

| | | | |
|---|---|---|---|
| 2,680,488 | 6/1954 | Atkinson | 166/241 |
| 3,055,432 | 9/1962 | Park | 166/241 |
| 3,356,147 | 12/1967 | Dreyfuss | 166/241 |
| 3,566,965 | 3/1971 | Solum | 166/241 |

FOREIGN PATENT DOCUMENTS

| | | | |
|---|---|---|---|
| 662,551 | 12/1951 | United Kingdom | 166/241 |
| 1,156,710 | 7/1969 | United Kingdom | 166/241 |

*Primary Examiner*—Stephen J. Novosad
*Attorney, Agent, or Firm*—William Anthony Drucker

[57] ABSTRACT

A centralizing device comprising a plurality of blades and a pair of substantially cylindrical collars adapted to receive and carry the blades. Each collar is formed with at least two parts detachably and/or pivotally connected to each other, and each collar carries inwardly extending deformable metal fixing projections. Each end of each blade is bent substantially at right angles to a portion of the blade adjacent the end. When the blades are fitted so as to lie internally of the collars, each bent end fits into a slot in one of the collars and the projections are deformed so as to lie on the sides of the blade portions remote from the collars to thus fix the portions to the collars.

9 Claims, 9 Drawing Figures

FIG. 1
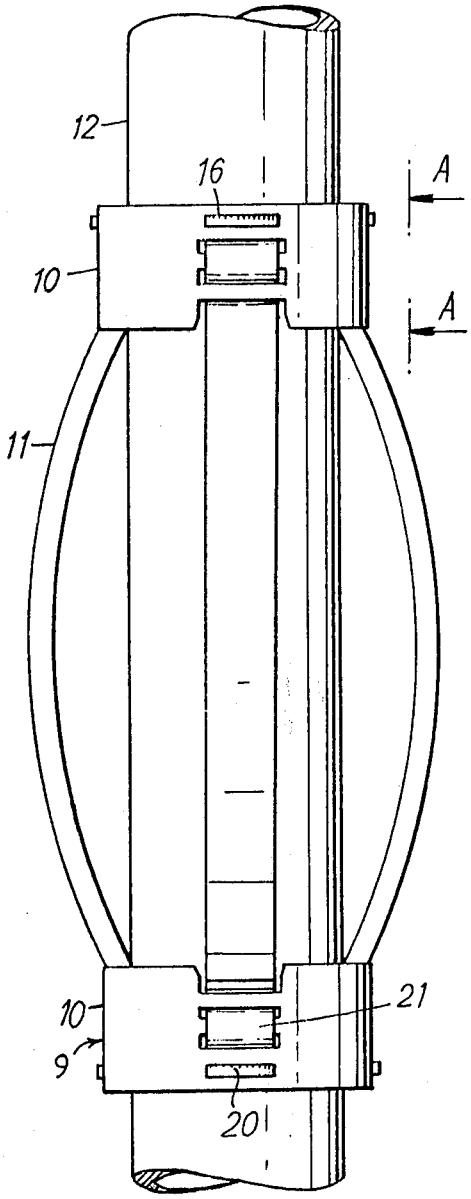
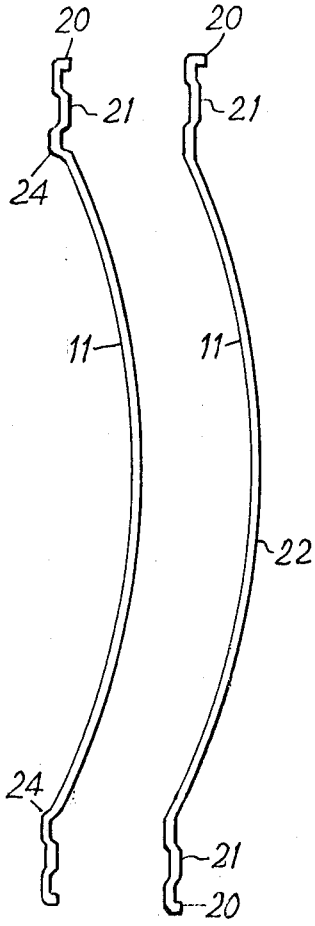
FIG. 2a FIG 2b

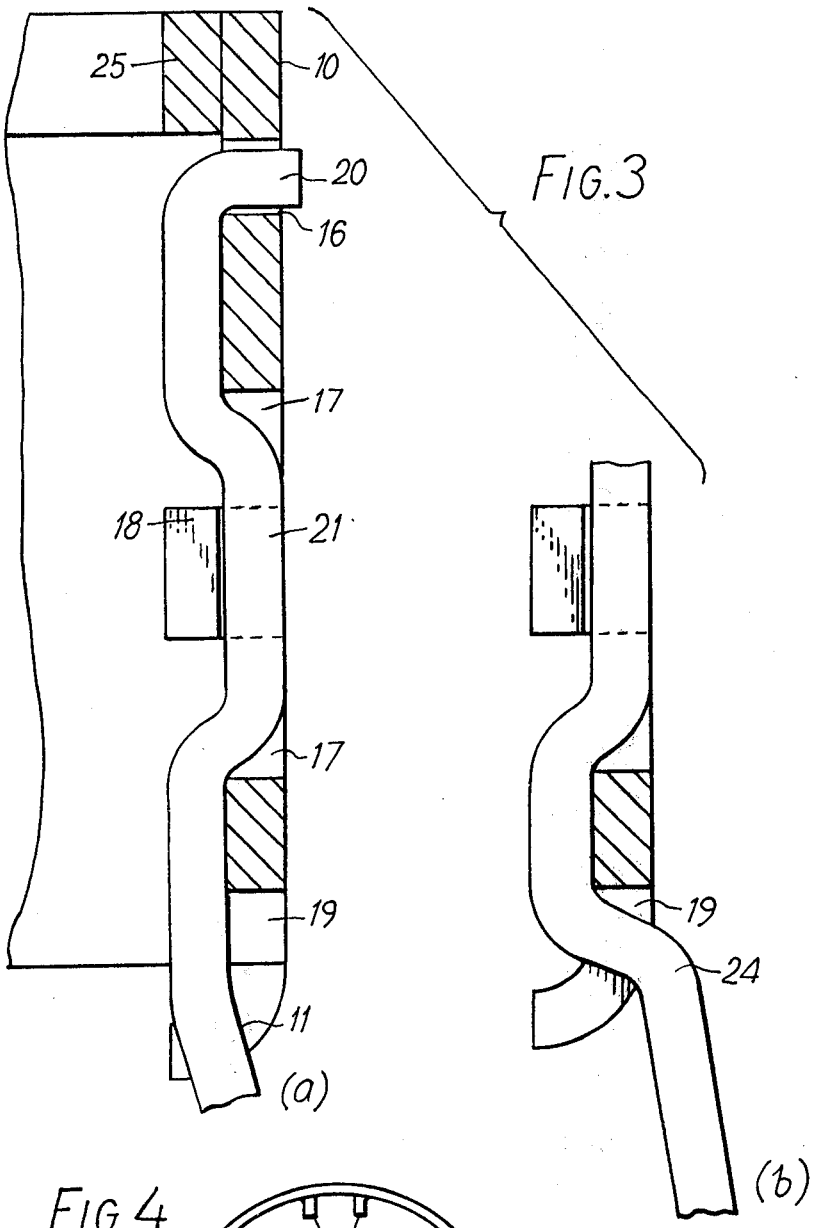
FIG. 3
FIG. 4
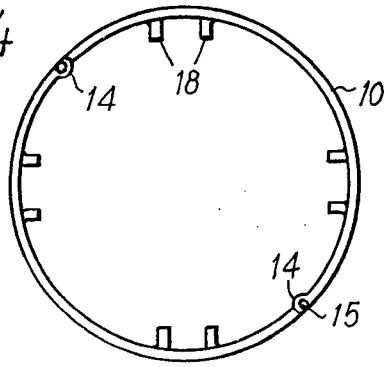

DEVICES FOR CENTRALIZING PIPES IN BORINGS

BACKGROUND OF THE INVENTION

The present invention relates to centralising devices which are used for centralising pipes or tubes (sometimes called casings) in borings, generally earth borings. In particular, this invention relates to an improved blade carrying ring or collar for use in centralising devices.

Centralisers are known in which the blades are secured externally to the collar, for example by welding, clipping or slotting into or onto the collar. An arrangement is also known in which the blades are secured internally of the collar, the blade end being passed through the collar material which has been deformed in a U-shape to accept the blade end. It has been said that the above methods of securing the blades may have disadvantages in cost of manufacture or weakness in construction or problems in usage in that welding of the blade material may create undesirable stresses in the steel and collars made from deformed metal can be expanded.

OBJECT OF THE INVENTION

An object of the invention is to provide a construction which is formed from few parts, the assembly of which is easily and rapidly facilitated, and yet is sufficienty constructed in such a manner to prevent the separation of the parts during use.

The centralising device made in accordance with this invention can be delivered as a kit of parts and can be easily assembled without special tools.

SUMMARY OF THE INVENTION

According to the invention there is provided a centralising device comprising a plurality of blades, a pair of substantially cylindrical collars each having at least two parts detachably connected to each other and adapted to receive and carry the blades, deformable metal fixing projections carried on each of said collars and extending inwardly therefrom, an upset element formed at each end of each blade substantially at right angles to a portion of the blade adjacent the end whereby when the blades are fitted so as to lie internally of the collars each bent end fits into a slot in one of said collars and said projections are deformed so as to lie on the sides of said blade portions remote from the collars to thus fix said portions to the collars.

In this manner, the bent over ends tend to be forced into the slots and the deformed projections are protected against damage by their engagement with the external surface of the casing. Also the projections are firmly held in position by their engagement with the casing.

Each collar may have two parts in the form of part-rings and the part-rings may be pivotably connected to each other. The pivotal connections may be hinges with pins and the pins may be detachable so that when a pin of a first pivotal connection is removed the two part-rings may pivot on a second pivotal connection and away from each other.

The number of blades comprising a centralising device may be three of more. The blades may be standardized for any bore but collars of various sizes may be provided according to the particular size of the pipe and bore.

The blades are preferably bowed and have a maximum diameter somewhat greater than that of the bore hole where the device is to be used. This ensures that the blades will be under compression when the device is in the bore, and thus the pipe entrained by the device will be accurately located centrally of the bore.

BRIEF DESCRIPION OF THE DRAWINGS

Constructional embodiments of the present invention will now be described by way of example, with reference to the accompanying drawings, wherein:

FIG. 1 is a side view of a centralising device made in accordance with one embodiment of the present invention shown mounted on a casing in which the tabs securing the blades are formed as part of the collar wall, FIG. 2(*a*) is a side view of an individual leaf spring or blade of the centralising device, FIG. 2(*b*) is a side view of an alternative embodiment of an individual blade, FIG. 3(*a*) is a detailed sectional view of the collar along the line A—A of FIG. 1 which illustrates the location of the blade attached to the collar, FIG. 3(*b*) is a similar view to FIG. 3(*a*) showing the location of the alternative blade, FIG. 4 is a plan view of the collar shown in FIG. 1, FIG. 5 shows a detail of the slotting in the collar of FIG. 1, FIG. 6 shows an alternative embodiment of the centralising device shown in FIG. 1 in which the tabs securing the blades are in the form of metal strips which pass through slots in the collar wall, and FIG. 7 is a detail of a blade end used in the centraliser of FIG. 6.

DESCRIPTION OF THE PREFERRED EMBODIMENTS

Figure 6:
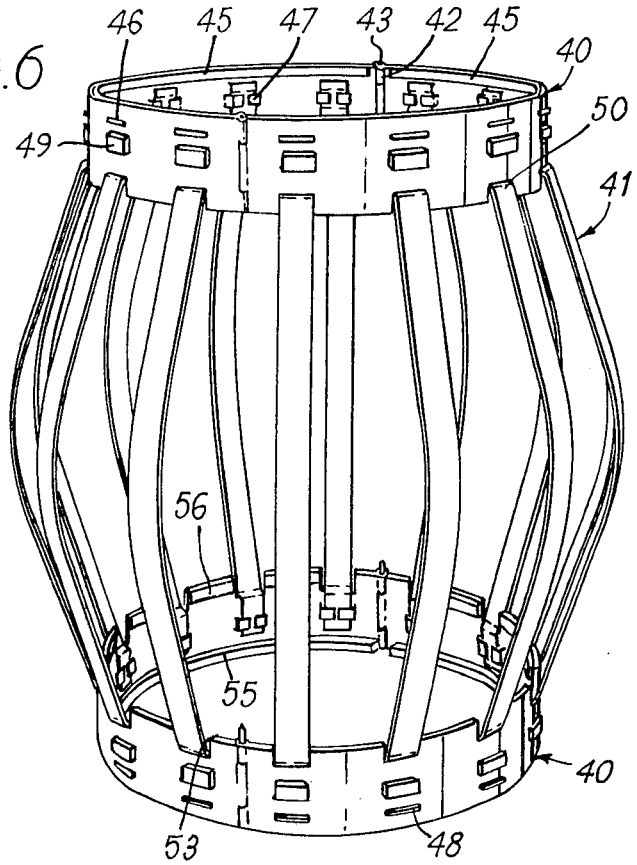

In general, as shown in FIG. 1 of the drawings, the first embodiment of a centralising device 9 has two collars or rings 10 which are adapted to receive and carry a plurality of blades or springs 11. The device is mounted on a casing 12.

Each collar 10 may be made from two part-rings which are pivotably attached to one another by means of hinges 14 (see FIG. 4). The part-rings may, or may not, be half-rings.

Each hinge 14 has a pin 15 which is detachable. Thus, by removing a pin 15 from its hinge 14 the two part-rings can be pivoted away from each other; the part-rings pivoting on the other hinge 14. When assembled the collar 10 is a rigid structure but the collar 10 can be rapidly dismantled by removing one of the pins 15 from its hinge.

Figure 5:
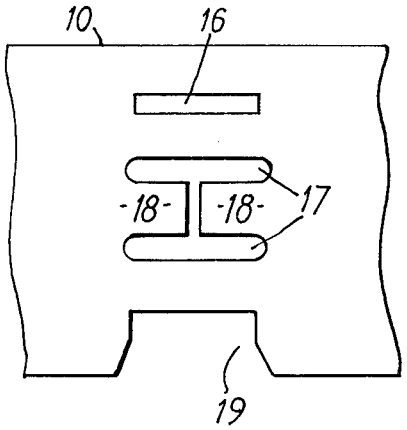

Slots 16 extend through the peripheral surface of the collars and these slots 16 are spaced symmetrically around the collars. The numbers of slots 16 provided in each collar corresponds to the number of blades 11, in this case four. In addition to the slots 16 (see FIG. 5) the collars are provided with additional slotting 17 which forms a pair of tabs or lugs 18. These are bent inwards (see FIG. 4) to allow assembly of the blades 11 with the collar, as described below. Cut away portion 19 is provided to allow movement of the blade under spring action when located on the casing 12. The blades 11 are preferably made from a resilient metal such as spring steel.

Each blade 11 has a lip 20 formed at each of its ends, and in assembling the device the lips 20 of the blades 11 are received by the slots 16 in the collars 10 (see FIG. 3(*a*)). In addition to the bent over lip 20, the blade is formed with a further offset portion 21, substantially U-shaped and of suitable dimensions so as to fit into the slotted portion 17 of the collar 10. A bowed central portion 22 is provided on the blade to centralise the device in use, and when assembled their developed length is longer than the distance between their points of attachment to the collars 10.

With the lips 20 of the blades 11 received in the slots 16, the blades 11 lie internally of the collars 10 with the offset portion 21 lying in the slot 17 (see FIG. 3(*a*)). The lugs 18 are then bent back towards each other so as to rigidly attach the blade to the collar. Thus, the blade is attached without the need of additional fixing means thereby reducing the number of component parts.

The lugs can be bent by any convenient means, e.g. hammering.

In the alternative blade shape shown in FIG. 2(*a*) and FIG. 3(*b*), the blade is provided with an additional step 24 which is located in the region of the cut away portion 19 of the collars 10 on assembly. This additional step 24 allows the centralising device 9 to be positioned on the casing by the use of a stop ring (not shown) fixed to the casing 12 in between the top and bottom collars 10. The step 24 prevents the blade bearing upon the stop ring. The spring action of the blades is still effective through cut away portion 19 of the collar.

The collars may be provided with a strengthening ring on their inside surfaces and this is shown as portion 25 in FIG. 3(*b*).

By locating the ends of either blade embodiment internally of the collars, the lips 20 are more firmly engaged within the slots. Since the lugs extend radially inwardly of the collars and can be deformed during assembly to lie flat against the blade, these lie against the casing surface so that they cannot move away from the blades and thus undesirably release the latter.

When the centraliser blades are in engagement with the well bore, the blades tend to pivot about the tabs.

In the embodiment of the centralising device of FIG. 6, two collars or rings 40 are adapted to receive and carry blades or springs 41.

Each collar 40 is made from two part-rings 45 which are pivotably attached to one another by means of hinges 42. The part-rings 45, may or may not be half-rings. Each hinge 42 has a pin 43 which is detachable. Thus, by removing a pin 43 from its hinge the two part-rings 45 can be pivoted away from each other; the part-rings pivoting on the other hinge 42. When assembled, the collar 40 is a rigid structure but the collar 40 can be rapidly dismantled by removing one of the pins 43 from its hinge.

Slots 46 extend through the peripheral surface of the collars and the slots 46 are spaced symmetrically around the collars. The number of slots 46 provided in each collar corresponds to the number of blades 41, in this case fourteen. The blades 41 are preferably made from a resilient metal such as spring steel. In addition to the slots 46, the collars are provided with fixing means in the form of pairs of lug members 47, each pair of lugs 47 is located adjacent one of the slots 46. Along the axially facing ends of the two collars are provided open ended slots 53 to be described below. Each collar is provided on its inside surface at one axial end with a ring 55, (e.g. ⅜inch or 5/16 inch thick) serving to strengthen the collar. At the other end arcuate blocks 56 may be welded to the collar between the slots 53 for strengthening purposes. Instead of these blocks the edge of the collar between the slots 53 may be turned over to achieve strengthening.

Figure 7:
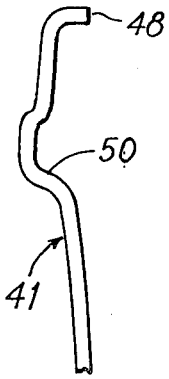

Each blade 41 has a lip 48 formed at each of its ends, and in assembling the device the lips 48 of the blades 41 are received by the slots 46 in the collars 40. In addition to the bent over lip 48, the end of the blade is formed with a further offset portion 50 disposed substantially parallel to the lip (see also FIG. 7) which offset portion forms the juncture of a bowed central portion 51 of the blade and the end portion 52 which lies against the collar.

With the lips 48 of the blades 41 received in the slots 46, the blades 41 lie internally of the collars 40 with the offset portion lying in an open-ended slot 53. The blades 41 are bowed so that, when assembled, their developed length is longer than the distance between their points of attachment to the collars 40. A pair of lugs 47 may be formed from a single strip 49 of material such as mild steel, and may be e.g. about ½inch wide, and ⅛inch thick. The strip 49 is bent into a U-shape and the arms of the strip 49 are passed through holes in the collar 40 so that the cross-piece of the strip 49 abuts the inner surface of the collar 40. Thereafter the cross-piece of the strip 49 is preferably rigidly attached to the collar, for example by spot welding. When the blades 41 are part assembled with their lips 48 extending through the slots 46, the final assembly operation is to bend the lugs 47, i.e., the arms of the strip 49 of each pair of lugs rigidly attach the blades 41 to the collars 40. Since the offset portions 50 extend beyond the outer surface of the collar, they serve to protect the collar and the strip 49 from damage.

By locating the ends of the blades internally of the collars, the lips 48 are more firmly engaged within the slots. It is also found necessary to pass the lugs through the collars so that the lugs extend radially inwardly of the collars and can be deformed during assembly to lie flat against the blade. Furthermore, the lugs lie against the casing surface so that they cannot move away from the blades and thus undesirably release the latter.

We claim:

1. A centralising device comprising:

a. a plurality of blades each having a bent portion at both ends substantially at right angles to a portion of the blade adjacent the ends;

b. a pair of substantially cylindrical collars adapted to receive and carry the blades and each having at least two parts detachably connected to each other and including a locating slot for receiving each blade end;

c. pairs of deformable metal fixing projections carried on each of said collars and extending inwardly therefrom for securing each of said blades to said collars, whereby when the blades are fitted so as to lie internally of the collars, each bent end portion of said blades fits into one of said locating slots in each of said collars and said projections are deformed so as to lie on the face of said blade portions remote from the collars to thus fix said blade portions to said collars.

2. A centralising device according to claim 1, wherein said fixing projections are formed by metal strips which pass through holes in the collar wall.

3. A centralising device according to claim 1, wherein said fixing projections are formed as part of the collar wall and which provide when deformed from the plane of the collar an additional slotted portion in said collar.

4. A centralising device according to claim 3, wherein said blades are provided with a U-shaped deformed portion which fits into the additional slotted portion in said collar.

5. A centralising device according to claim 1, wherein each collar comprises two half-rings pivotably connected by means of two hinges, each hinge including a removable pin to allow pivoting of said half-rings on the other of said hinges.

6. A centralising device according to claim 1, wherein a ring is provided on an internal face of said collars to strengthen them.

7. A centralising device according to claim 1, wherein arcuate blocks are provided on an internal face of said collars to strengthen them.

8. A centralising device according to claim 1, wherein an inwardly projecting U-shaped portion is provided close to the end of said blade but spaced from the bent over end, said inwardly projecting portion being engageable with a stop ring when located on a casing.

9. A centralising device according to claim 1, wherein each blade includes a bowed central portion positioned external to said collars when fitted thereto to provide resilient centralising for the device and each collar includes cut away portions to allow resilient movement of said blades.

* * * * *